US007435889B1

(12) United States Patent
Heidt

(10) Patent No.: US 7,435,889 B1
(45) Date of Patent: Oct. 14, 2008

(54) ROTATABLE DRUMSTICK TETHER

(76) Inventor: Erik Heidt, 3062 Doxberry Ct., Clearwater, FL (US) 33761

( * ) Notice: Subject to any disclaimer, the term of this patent is extended or adjusted under 35 U.S.C. 154(b) by 0 days.

(21) Appl. No.: 11/642,806

(22) Filed: Dec. 20, 2006

(51) Int. Cl.
*G10D 13/02* (2006.01)

(52) U.S. Cl. ..... 84/422.4; 84/320; 84/322

(58) Field of Classification Search ..... 84/422.4, 84/320, 322
See application file for complete search history.

(56) References Cited

U.S. PATENT DOCUMENTS

| | | | | | |
|---|---|---|---|---|---|
| 361,535 | A | * | 4/1887 | Merrick | 401/8 |
| 892,812 | A | * | 7/1908 | Day | 131/258 |
| 1,163,866 | A | * | 12/1915 | Sexton | 224/217 |
| 1,286,610 | A | * | 12/1918 | Harriman | 224/217 |
| 1,519,816 | A | * | 12/1924 | Ward | 30/298 |
| 1,891,431 | A | * | 12/1932 | Markart | 131/258 |
| 2,084,343 | A | * | 6/1937 | Jefferis | 131/258 |
| 2,109,609 | A | * | 3/1938 | Aull | 131/258 |
| 2,447,328 | A | * | 8/1948 | Gerrits | 473/205 |
| 2,541,415 | A | * | 2/1951 | Grafstein | 63/15.6 |
| 2,548,517 | A | * | 4/1951 | Clark | 81/3.57 |
| 2,776,592 | A | * | 1/1957 | Di Preta | 84/322 |
| 3,365,108 | A | * | 1/1968 | Giba | 224/217 |
| 3,442,169 | A | * | 5/1969 | Bowers | 84/322 |
| 3,789,720 | A | * | 2/1974 | McIntyre | 84/322 |
| 3,859,887 | A | * | 1/1975 | Buchanan | 84/422.4 |
| 3,930,510 | A | * | 1/1976 | Johnston | 131/258 |
| 4,067,255 | A | * | 1/1978 | Camaioni | 84/322 |
| 4,270,433 | A | * | 6/1981 | Adamec | 84/322 |
| 4,447,912 | A | * | 5/1984 | Morrow | 2/159 |
| 4,651,617 | A | * | 3/1987 | Schwartz | 84/422.4 |
| D291,809 | S | * | 9/1987 | Jasper | D17/20 |
| 4,738,556 | A | * | 4/1988 | Brown | 401/7 |
| D297,546 | S | * | 9/1988 | Seals | D17/22 |
| 4,856,688 | A | * | 8/1989 | Ackmann | 224/217 |
| 4,982,641 | A | * | 1/1991 | Duhart | 84/329 |
| 5,370,030 | A | * | 12/1994 | Horne | 84/422.4 |

(Continued)

OTHER PUBLICATIONS

The Triplet™ Drum Glove, inventor James A. Lento, © 2004, viewed Dec. 31, 2007, http://www.drumglovemusic.com/ustrdrglwiva.html.*

(Continued)

*Primary Examiner*—Lincoln Donovan
*Assistant Examiner*—Robert W Horn
(74) *Attorney, Agent, or Firm*—Frijouf, Rust & Pyle, P.A.

(57) ABSTRACT

A drumstick tether is disclosed for rotatably securing a drumstick to a finger of a drummer comprising a first elongate strip of flexible material adapted to wrap around the finger of the drummer and a second elongate strip of flexible material adapted to wrap around the drumstick. The first elongate strip of flexible material is secured to a first swivel part of a swivel member for securing the drumstick tether to the finger of the drummer. The second elongate strip of flexible material is secured to a second swivel part of the swivel member for securing the drumstick tether to the drumstick. The swivel member has a transverse swivel length greater than an axial swivel length for positioning the drumstick in close proximity to the finger of the drummer for enabling a closed hand of the drummer to hold the drumstick in a conventional manner and for enabling an opening hand of the drummer to theatrically twirl the drumstick about the swivel member.

8 Claims, 3 Drawing Sheets

U.S. PATENT DOCUMENTS

| | | | | | |
|---|---|---|---|---|---|
| 5,398,524 | A | * | 3/1995 | Rochez | 63/15 |
| D362,264 | S | * | 9/1995 | Trees | D17/20 |
| 5,581,031 | A | * | 12/1996 | Blankenship, Jr. | 84/453 |
| 5,781,999 | A | * | 7/1998 | Chang | 30/260 |
| 5,837,913 | A | * | 11/1998 | Newman | 84/329 |
| 5,856,627 | A | * | 1/1999 | George | 84/322 |
| D410,212 | S | * | 5/1999 | Otero | D11/26 |
| D414,311 | S | * | 9/1999 | Westmoreland | D2/614 |
| 6,118,058 | A | * | 9/2000 | Rowley | 84/320 |
| 6,118,062 | A | * | 9/2000 | Thoman | 84/422.4 |
| 6,127,613 | A | * | 10/2000 | Hansel | 84/332 |
| 6,213,952 | B1 | * | 4/2001 | Finarov et al. | 600/491 |
| 6,249,277 | B1 | * | 6/2001 | Varveris | 345/179 |
| 6,271,451 | B1 | * | 8/2001 | Gress | 84/422.4 |
| 6,393,615 | B1 | * | 5/2002 | Bedell | 2/161.1 |
| 6,553,574 | B1 | * | 4/2003 | Hall et al. | 2/160 |
| 6,626,598 | B2 | * | 9/2003 | Schneider | 401/8 |
| 6,734,349 | B1 | * | 5/2004 | Adams | 84/322 |
| 6,778,380 | B2 | * | 8/2004 | Murray, Jr. | 361/679 |
| 6,786,113 | B2 | * | 9/2004 | Brailsford et al. | 81/3.55 |
| 6,797,871 | B2 | * | 9/2004 | Atkin | 84/322 |
| 6,810,531 | B1 | * | 11/2004 | Lento | 2/159 |
| D508,965 | S | * | 8/2005 | Golliher | D21/566 |
| 6,977,330 | B2 | * | 12/2005 | Santa Cruz et al. | 84/322 |
| 7,165,475 | B2 | * | 1/2007 | Teppe | 81/3.55 |
| 7,173,176 | B2 | * | 2/2007 | Nybye | 84/422.4 |

OTHER PUBLICATIONS

Stop Drops® Drum/Finger Loop, Fowler Drumming, Inc., viewed Dec. 31, 2007, http://www.stop-drops.com/ Howe to hold your drumsticks.*

* cited by examiner

ROTATABLE DRUMSTICK TETHER

BACKGROUND OF THE INVENTION

1. Field of the Invention

This invention relates, generally, to tools used with musical instruments. More particularly, it relates to a tether attached to a finger of a drummer at a first end and to a drumstick at a second end.

2. Description of the Prior Art

Drummers in differing types of bands can drop one or both of their drumsticks, thereby diminishing the musical performance. Dropped drumsticks are usually the result of hands that are moist and slippery. The moisture may result from perspiration caused by prolonged or especially energetic drumming. It may also be caused by the environment, such as when a marching band gets caught in a downpour.

Most drummers are equipped with a holster filled with additional drumsticks which they can grab quickly as needed, but if the newly retrieved drumsticks also become slippery, the problem becomes more serious.

Drummers sometimes embellish their performance by theatrically twirling one or both drumsticks for a few moments. With practice, the artist can learn to twirl the drumsticks in a crowd-pleasing way. However, if a drumstick is dropped, the positive effect is lost and a few beats may be missed as well. If the band is a marching band, new drumsticks must be retrieved from the holster and retrieval of the dropped drumstick or drumsticks must be undertaken before the athletic teams re-take the field.

Thus there is a need for a tool that enables a drummer to hold onto a drumstick even with hands that are moist and slippery due to any cause.

Several manufacturers provide gloves for drummers to alleviate this problem. However, many drummers prefer not to wear gloves when practicing or performing. Other manufacturers provide drumstick wax that is rubbed onto the drumsticks to make them less slippery. Sticky drumsticks are difficult to re-grip and many drummers do not care for the feel of such drumsticks.

There is also a need for a tool that enables a drummer to rapidly twirl the drumsticks whenever desired without fear of dropping them. Gloves do not address this aspect of drumming, and sticky drumsticks are more difficult to twirl than untreated drumsticks.

A drummer having perfectly dry hands can also lose the grip on a drumsticks if a cramp arises.

Thus there is a need for a tether that can prevent loss of a drumstick during a hand cramp so that the drummer can allow the cramp to subside without loss of the stick.

Soft padding material is preferably secured to the interior side of the first end of the finger strap so that the finger of a drummer bears against the cushioned material when the finger strap is worn properly.

Similarly, the drum strap is also an elongate strip of flexible material having opposed ends that overlap when the material is wrapped around a drumstick. The midpoint of the elongate strip is fixedly secured by a suitable fastening means to a second, opposite side of the swivel member.

A hook or loop material is secured to a first end of the drum strap on an interior side of the strap and a complementary material is secured to a second end of the drum strap on an exterior side of the strap. The hook or loop material therefore overlies and releasably engages the complementary material when the strap is wrapped around a drumstick.

In a preferred embodiment, the interior side of the second end of the drum strap is adhered to the drumstick so that the drumstick is still held by the novel tether even if the opposed ends of the drum strap become disengaged from one another.

A screw or rivet extends diametrically through the swivel member and holds the outer part of the swivel member against rotation when an inner axle part of the swivel member rotates conjointly with a drumstick.

Advantageously, the novel construction is retrofit onto a conventional drumstick and does not require structural alteration of the drumstick. It is used without gloves and without wax.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
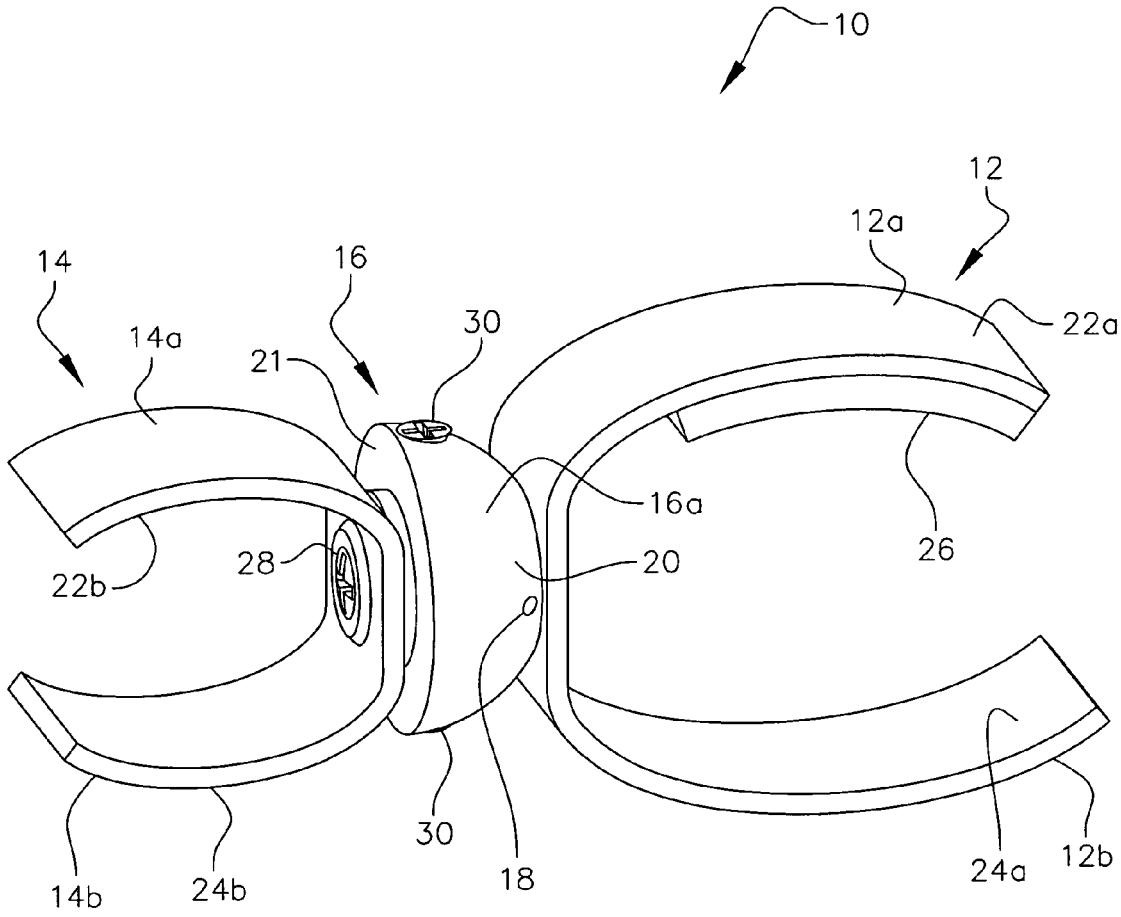
FIG. 1 is a side elevational view of the novel rotatable drumstick tether.
Figure 2:
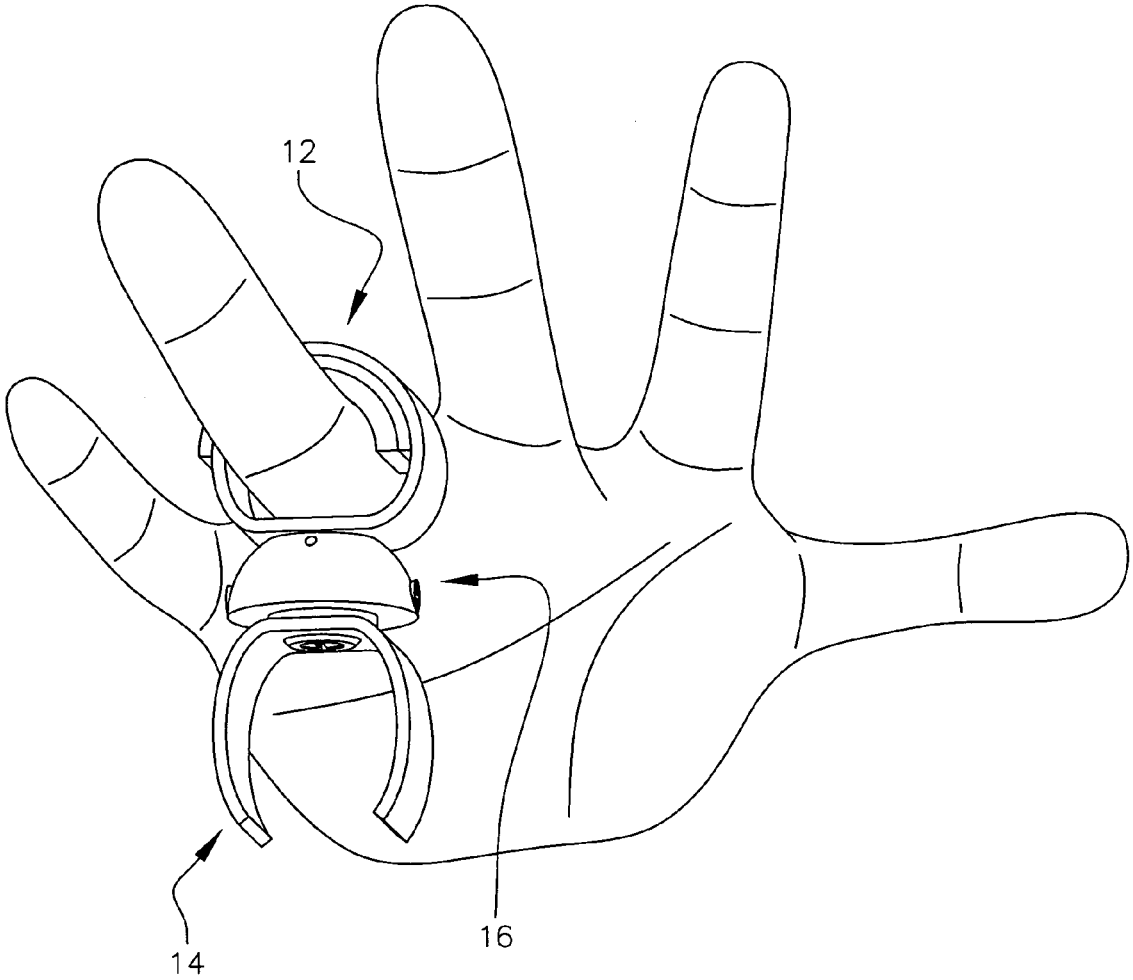
FIG. 2 is a first perspective view of the rotatable drumstick tether when attached to the ring finger of a drummer.
Figure 3:
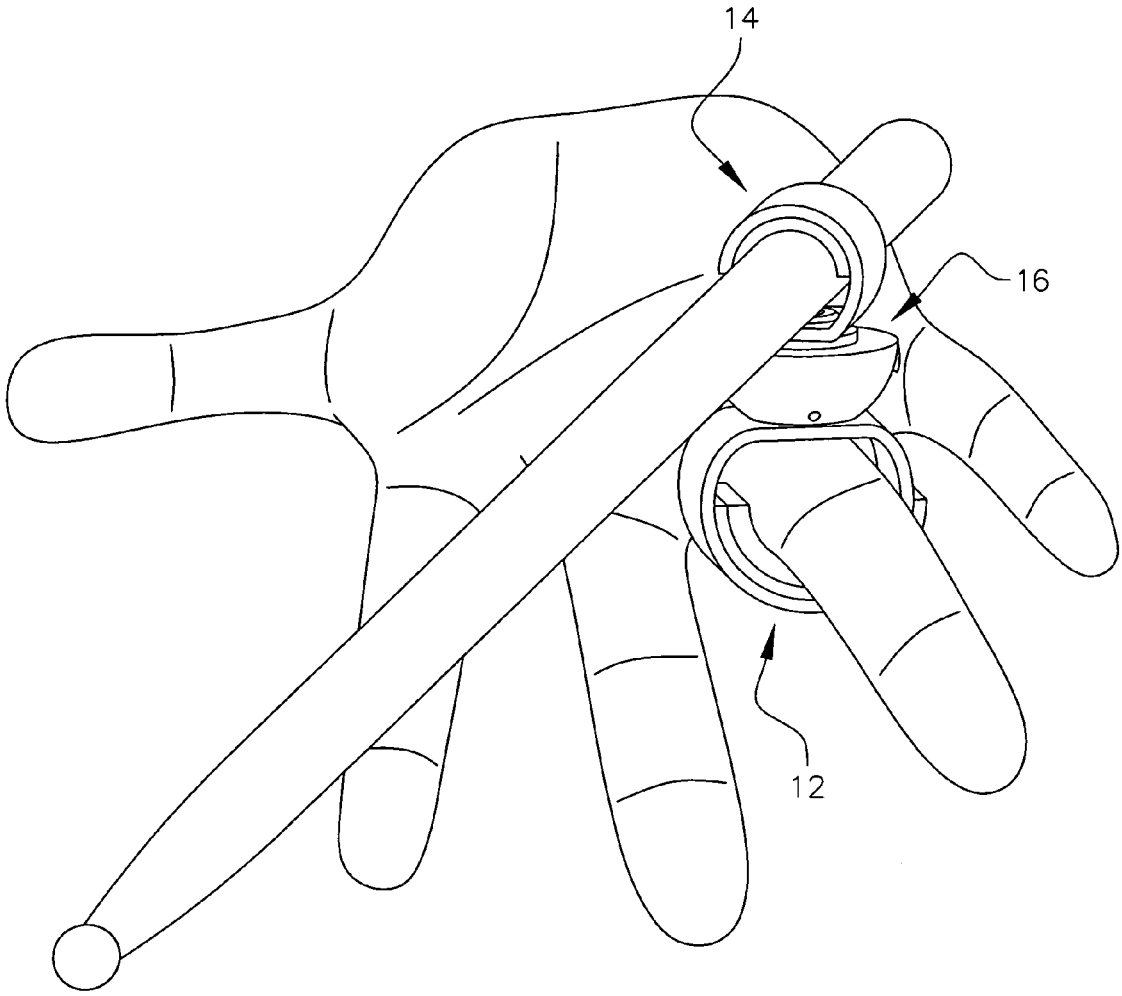
FIG. 3 is a second perspective view of the rotatable drumstick tether when attached to the ring finger of a drummer and when holding a drumstick.

Referring now to FIGS. 1-3, it will there be seen that an illustrative embodiment a rotatable drumstick tether of the invention is denoted as a whole by the reference numeral 10.

The rotatable drumstick tether 10 has three (3) primary parts. Finger strap 12 is adapted to releaseably engage a finger, drum strap 14 is adapted to releasably engage a drumstick, and swivel 16 interconnects finger strap 12 to drum strap 14.

Finger strap 12 is an elongate strip of flexible material having opposed ends that overlap when the material is wrapped around a finger. The midpoint of the elongate strip is fixedly secured by a suitable fastening means such as pin 18 to the curved side 20 of swivel 16 having a hemispherical shape in this particular embodiment. Swivels having other shapes are within the scope of this invention and finger strap 12 may be secured to either side thereof.

A loop material 22*a* is secured to a first end 12*a* of finger strap 12 on an exterior side of said strap and a hook material 24*a* is secured to a second end 12*b* of said finger strap on an interior side of the strap. The hook material overlies and engages the loop material when the strap is wrapped around a finger. The hook and loop material may be reversed with the hook material secured to the exterior side of the first end and the loop material secured to the interior side of the second end.

Soft padding material 26 is preferably secured to the interior side of first end 12*a* of finger strap 12 so that the finger of the drummer bears against said cushioned material when finger strap 12 is properly worn.

Drum strap 14 is also an elongate strip of flexible material having opposed ends that overlap when the material is wrapped around a drumstick. In this embodiment, the midpoint of the elongate strip is fixedly secured by a suitable fastening means such as screw 28 to the flat side 21 of swivel 16 but in other embodiments it could be secured to the curved side of said swivel. Moreover, as aforesaid, swivel member 16 need not have a hemispherical shape.

A hook 22*b* material is secured to first end 14*a* of drum strap 14 on an interior side of said strap and a loop material 24*b* is secured to second end 14*b* of said drum strap on an exterior side of the strap. The hook material overlies and engages the loop material when the strap is wrapped around a drumstick. The hook and loop material may be reversed with the hook material secured to the exterior side of the first end and the loop material secured to the interior side of the second end.

In a preferred embodiment, the interior side of second end 14*b* is adhered to the drumstick so that the drumstick is still held by the novel tether even if the opposed ends of the drum strap 14 become disengaged from one another.

Screw or rivet 30 extends diametrically through swivel member 16 and holds the outer part 16*a* of swivel 16 against rotation when an inner axle part of said swivel, not depicted, rotates conjointly with a drumstick.

The swivel 16 has a first swivel part and a second swivel part with the second swivel part being rotatable relative to the first swivel part about a swivel axis. The first elongate strip of flexible material 12 is secured to the first swivel part of the swivel member for securing the drumstick tether 10 to the finger of the drummer. The second elongate strip of flexible material 14 is secured to the second swivel part of the swivel member for securing the drumstick tether 10 to the drumstick. The swivel 16 extends axially along the swivel axis for defining an axial swivel length. The swivel 16 extends transverse to the swivel axis defining a transverse swivel length. The axial swivel length of the swivel 16 is less than the transverse swivel length of the swivel 16 for positioning the drumstick in close proximity to the finger of the drummer for enabling a closed hand of the drummer to hold the drumstick in a conventional manner and for enabling an opening hand of the drummer to theatrically twirl the drumstick about the swivel member.

Although the straps have been referred to herein as the finger strap and the drumstick strap, such straps are interchangeable for all practical purposes. For example, the finger strap may be secured to either side of swivel 16, i.e., the flat side or the curved side, and the drum strap may be secured to either side as well. Moreover, as mentioned above, there is no requirement that the swivel member have a hemispherical configuration. More important is the fact that both straps are directly secured at their respective midpoints to the swivel member so that the distance between the finger and the drumstick is minimized.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A drumstick tether for rotatably securing a drumstick to a finger of a drummer, comprising:

a first elongate strip of flexible material adapted to wrap around the finger of the drummer;

a second elongate strip of flexible material adapted to wrap around the drumstick;

a swivel having a first swivel part and a second swivel part with said second swivel part being rotatable relative to said first swivel part about a swivel axis;

said first elongate strip of flexible material being secured to said first swivel part of said swivel for securing the drumstick tether to the finger of the drummer;

said second elongate strip of flexible material being secured to said second swivel part of said swivel for securing the drumstick tether to the drumstick;

said swivel extending axially along said swivel axis for defining an axial swivel length;

said swivel extending transverse to said swivel axis defining a transverse swivel length; and said axial swivel length of said swivel being less than said transverse swivel length of said swivel for positioning the drumstick in close proximity to the finger of the drummer for enabling a closed hand of the drummer to hold the drumstick in a conventional manner and for enabling an opening hand of the drummer to theatrically twirl the drumstick about said swivel.

2. A drumstick tether as set forth in claim 1, including a soft padding material secured to a portion of an interior side of said first elongate strip of flexible material for bear against the finger of the drummer.

3. A drumstick tether as set forth in claim 1, wherein an interior side of said second strip of elongate flexible material includes an adhesive for securing said second strip of elongate flexible material to said drumstick.

4. A drumstick tether as set forth in claim 1, wherein said first swivel part defines a first swivel part diameter and said second swivel part defines a second swivel part diameter; and said first swivel part diameter being greater than said first swivel part diameter.

5. A drumstick tether as set forth in claim 1, wherein said first swivel part is non-rotatable outer part relative to the finger of the drummer; and said second swivel part being a rotatable inner part relative to said non-rotatable outer part.

6. A drumstick tether as set forth in claim 1, wherein said swivel defines a hemispherical shape defining a curved side and a flat side;

said first strip of elongate flexible material being secured to said curved side of said swivel; and said second strip of elongate flexible material being secured to said flat side of said swivel.

7. A drumstick tether for rotatably securing a drumstick to a finger of a drummer, comprising:

a first elongate strip of flexible material adapted to wrap around the finger of the drummer;

said first elongate strip of flexible material having opposed ends that overlap when said first elongate strip of flexible material is wrapped around said finger;

a first hook and loop fastening material secured to a first end of said second elongate strip of flexible material and a complementary first hook and loop fastening material secured to a second end of said second elongate strip of flexible material;

a second elongate strip of flexible material adapted to wrap around the drumstick;

said second elongate strip of flexible material having opposed ends that overlap when said second elongate strip of flexible material is wrapped around the drumstick;

a second hook and loop fastening material secured to a first end of said second elongate strip of flexible material and a complementary second hook and loop fastening material secured to a second end of said second elongate strip of flexible material;

a swivel having a first swivel part and a second swivel part with said second swivel part being rotatable relative to said first swivel part about a swivel axis;

said first elongate strip of flexible material being secured to said first swivel part of said swivel for securing the drumstick tether to the finger of the drummer;

said second elongate strip of flexible material being secured to said second swivel part of said swivel for securing the drumstick tether to the drumstick;

said swivel extending axially along said swivel axis for defining an axial swivel length;

said swivel extending transverse to said swivel axis defining a transverse swivel length; and said axial swivel length of said swivel being less than said transverse swivel length of said swivel for positioning the drumstick in close proximity to the finger of the drummer for enabling a closed hand of the drummer to hold the drumstick in a conventional manner and for enabling an opening hand of the drummer to theatrically twirl the drumstick about said swivel.

8. A drumstick tether for rotatably securing a drumstick to a finger of a drummer, comprising:

a first flexible material adapted to wrap around the finger of the drummer;

a second flexible material adapted to wrap around the drumstick;

a swivel having a first swivel part and a second swivel part with said second swivel part being rotatable relative to said first swivel part about a swivel axis;

said swivel axis restricting rotation of said second swivel part to be within a plane perpendicular to said swivel axis;

said first flexible material being secured to said first swivel part of said swivel for securing the drumstick tether to the finger of the drummer;

said second flexible material being secured to said second swivel part of said swivel for securing the drumstick tether to the drumstick;

said swivel extending axially along said swivel axis for defining an axial swivel length;

said swivel extending transverse to said swivel axis defining a transverse swivel length; and said axial swivel length of said swivel being less than said transverse swivel length of said swivel for positioning the drumstick in close proximity to the finger of the drummer for enabling a closed hand of the drummer to hold the drumstick in a conventional manner and for enabling an opening hand of the drummer to theatrically twirl the drumstick about said swivel.

* * * * *